US006767111B1

(12) United States Patent
Lai

(10) Patent No.: US 6,767,111 B1
(45) Date of Patent: Jul. 27, 2004

(54) PROJECTION LIGHT SOURCE FROM LIGHT EMITTING DIODES

(76) Inventor: Kuo-Yen Lai, No. 58-8, Ma-Yuan Li, Chu-Pei, Hsin-Chu 302 (TW)

( * ) Notice: Subject to any disclaimer, the term of this patent is extended or adjusted under 35 U.S.C. 154(b) by 0 days.

(21) Appl. No.: 10/372,849

(22) Filed: Feb. 26, 2003

(51) Int. Cl.[7] ..... F21V 13/04

(52) U.S. Cl. ..... 362/240; 362/328; 362/335; 362/800

(58) Field of Search ..... 362/336, 338, 362/237, 240, 242, 243, 245, 255, 256, 327, 328, 329, 330, 331, 332, 335, 800

(56) References Cited

U.S. PATENT DOCUMENTS 4,935,665 A * 6/1990 Murata ..... 362/800
5,241,457 A * 8/1993 Sasajima et al. ..... 362/800
6,672,746 B2 * 1/2004 Amano ..... 362/330
2003/0156410 A1 * 8/2003 Ter-Hovhannisian ..... 362/245

* cited by examiner

*Primary Examiner*—Y My Quach Lee
(74) *Attorney, Agent, or Firm*—H. C. Lin

(57) ABSTRACT

The light emitted from a bank of light emitting diodes is converted through a set of lenses into parallel light beams, which, in turn, is focused or diversified as projection light source. Such a light source can replace traditional incandescent bulb. Reflection mirrors can be used to deflect or reflect the light beams. Phosphorescent material can be added in the transmission path to convert blue or ultraviolet short wave light into white light.

9 Claims, 13 Drawing Sheets

PROJECTION LIGHT SOURCE FROM LIGHT EMITTING DIODES

BACKGROUND OF THE INVENTION (1) Field of the Invention

This invention relates to light emitting diodes (LED), in particular to LED for projection light source.

(2) Brief Description of Related Art

FIG. 1 shows a prior art light bulb. The light bulb has a shell 10 and a filament 12. When an electric current flows through the filament 12, the filament 12 is heated up and emits light. This kind of light bulb is inefficient and generates a great deal of heat.

SUMMARY OF THE INVENTION

An object of this invention is to provide an efficient light source. Another object of this invention is to generate less heat from the light source.

These objects are achieved by using a number of LEDs as a light source. The light emitted from the LEDs is converted through lenses to produce parallel light beams. The parallel light beams are focused or diversified as projection light source. The light source can replace traditional incandescent light bulb. Reflection mirrors can be used to deflect or reflect the light beams. Phosphorescent material can be added in the transmitting media or coated on the light transmitting surface to convert blue or ultraviolet short wavelength light into white light.

DETAILED DESCRIPTION OF THE INVENTION

Figure 2:
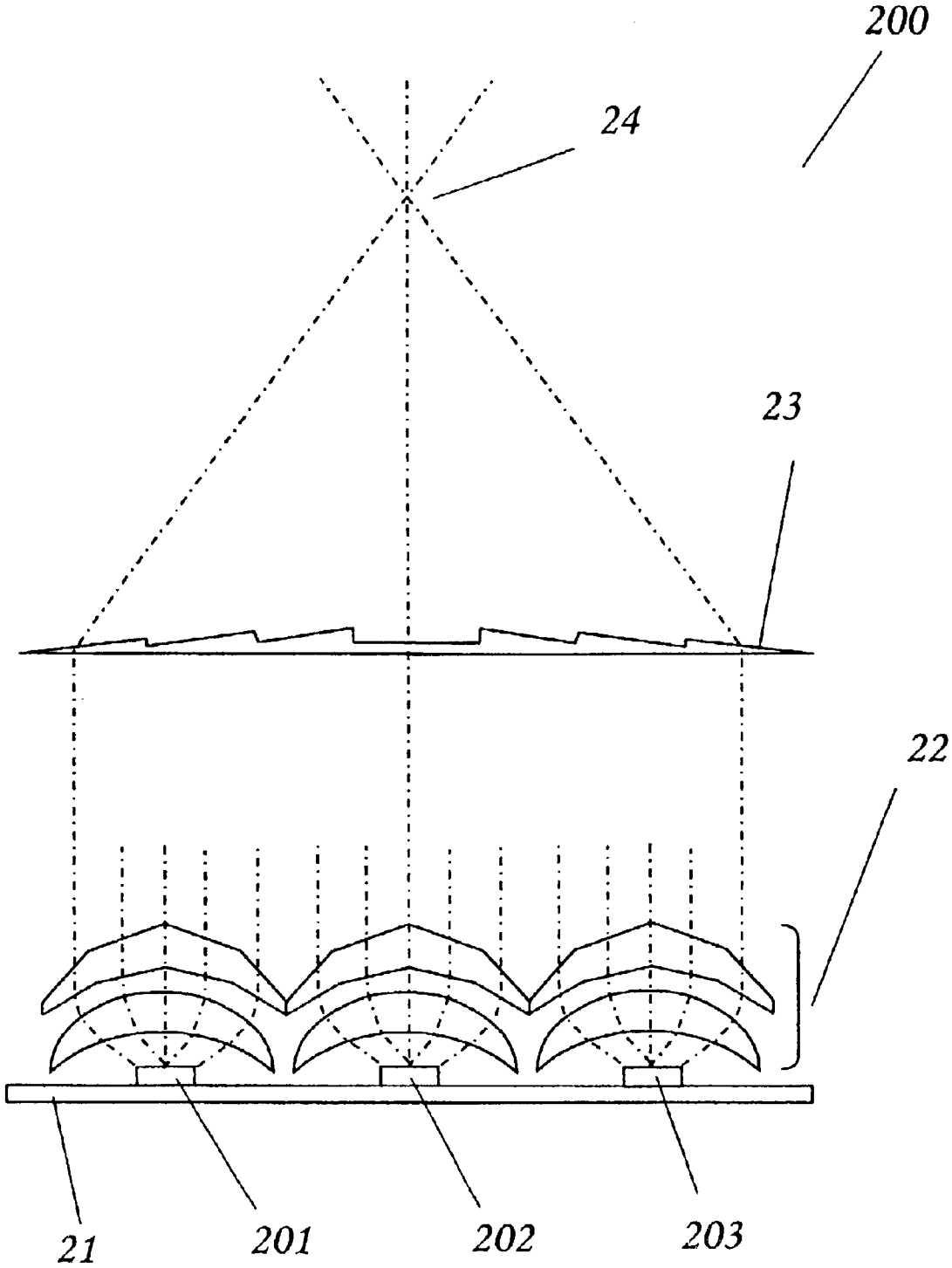
FIG. 2 shows the first embodiment of the present invention with multiple LEDs to first generate parallel light beams through a first set of lenses and then focused light source through a Fresnel lens.

FIG. 2 shows the basic projection light source system of the present invention. Multiple light emitting diodes (LED) 201, 202, 203 are mounted on a substrate 21. Each of these LEDs is placed at the respective focal points of a set of lenses 22, so that the light beams emitted from the LED become parallel. The first set of lenses 22 can be a single lens or multiple lenses. The parallel light beams are then focused through a second set of lens 23 at a focal point 24. The second set of lens shown here is a Fresnel lens.

Figure 3:
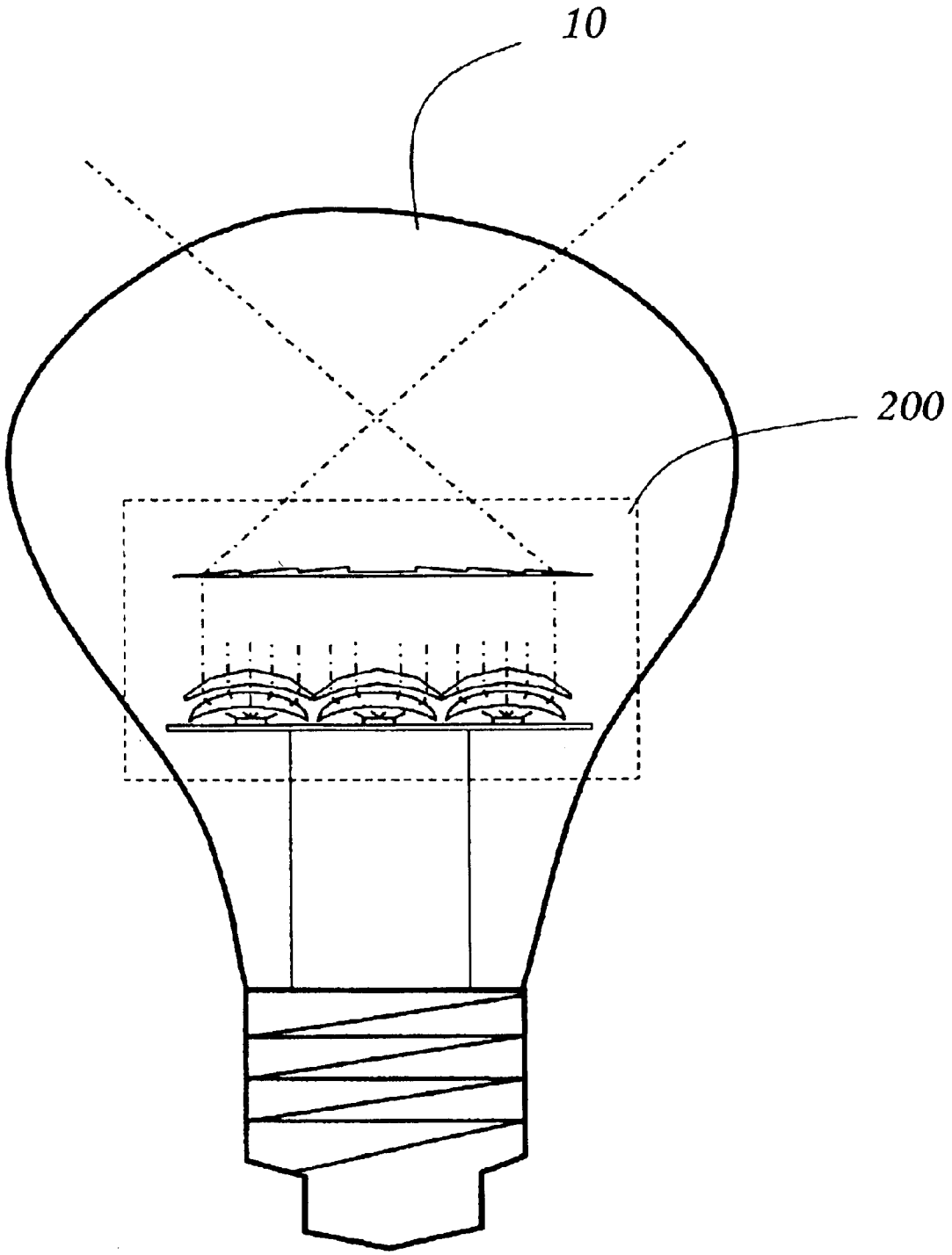
FIG. 3 shows a second embodiment of the invention where a LED light source is enclosed in a bulb.

FIG. 3 shows a second embodiment of the present invention. The light source system 200 shown in FIG. 2 is mounted inside a conventional light bulb 10. The second set of lens shown is a Fresnel lens. The light bulb 10 then can be used as a conventional light bulb.

Figure 4:
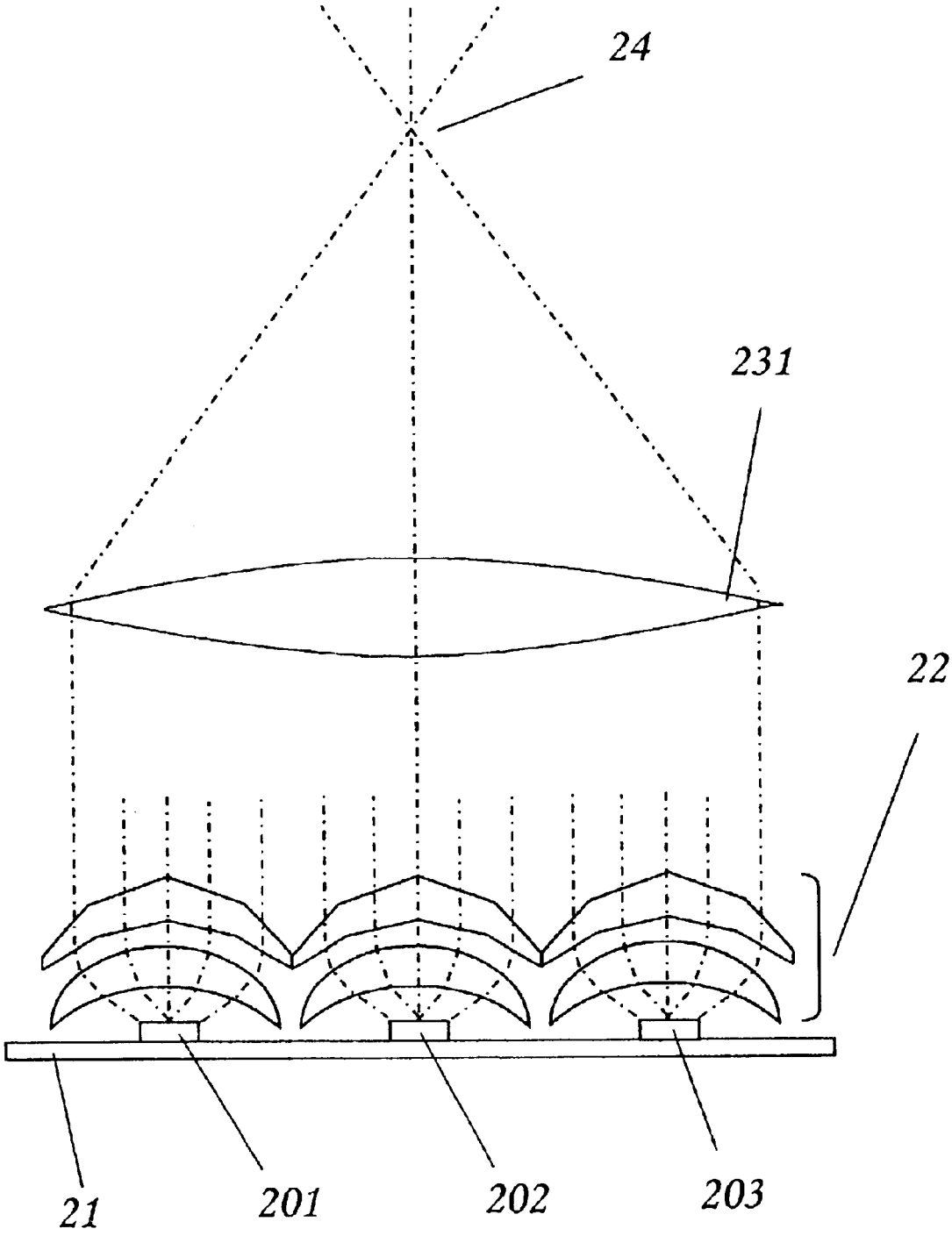
FIG. 4 shows a third embodiment of the invention to generate a focused light through a convex lens from parallel light beams converted from the LEDs.

FIG. 4 shows a third embodiment of the present invention. The light source system is similar to that in FIG. 2 with LEDs 201, 202, 203 mounted on substrate 21. The difference is that the second set of focal lens is a conventional convex lens 231 to focus the parallel light beams at a focal point 24.

Figure 5:
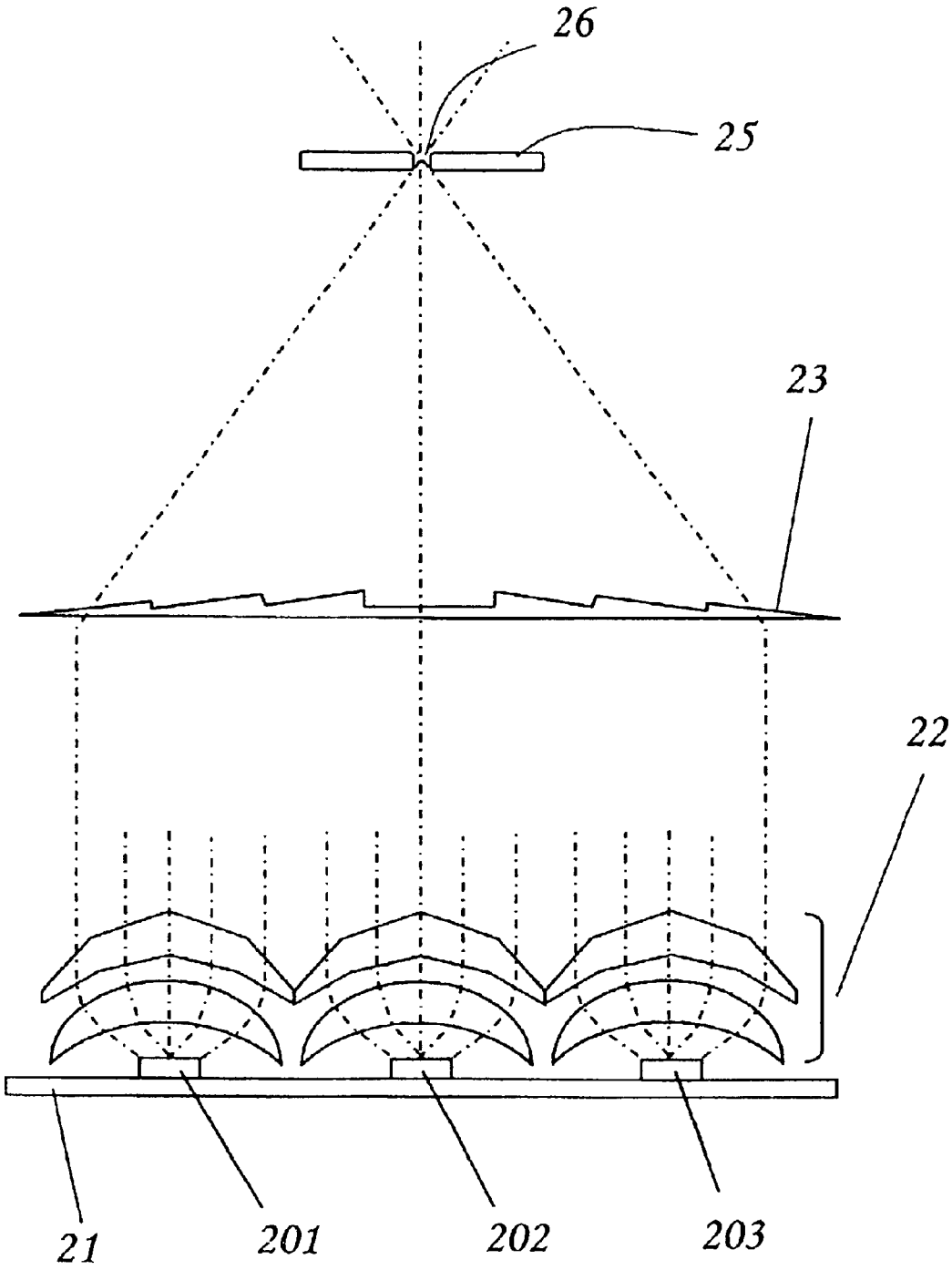
FIG. 5 shows a fourth embodiment of the invention, where a focused light is transmitted through a pinhole.

FIG. 5 shows a fourth embodiment of the present invention. The light system is similar to FIG. 2 except that the parallel light beams, which are emitted from the LEDs 201, 202, 203 mounted on substrate 21 through first set of lenses 22 and focused by the second set of lens 23, transmit through a pinhole 26 of a plate 25 placed at the focal point of the focused light beams. The purpose of the of the pinhole 26 is to correct the departure of the focused light as a point source due to aberrations in the first set of lens 22 and the second set of lens 23, thus sharpening the light beam. With the light beaming through the pinhole 26, the light source approaches that of a point source.

Figure 6:
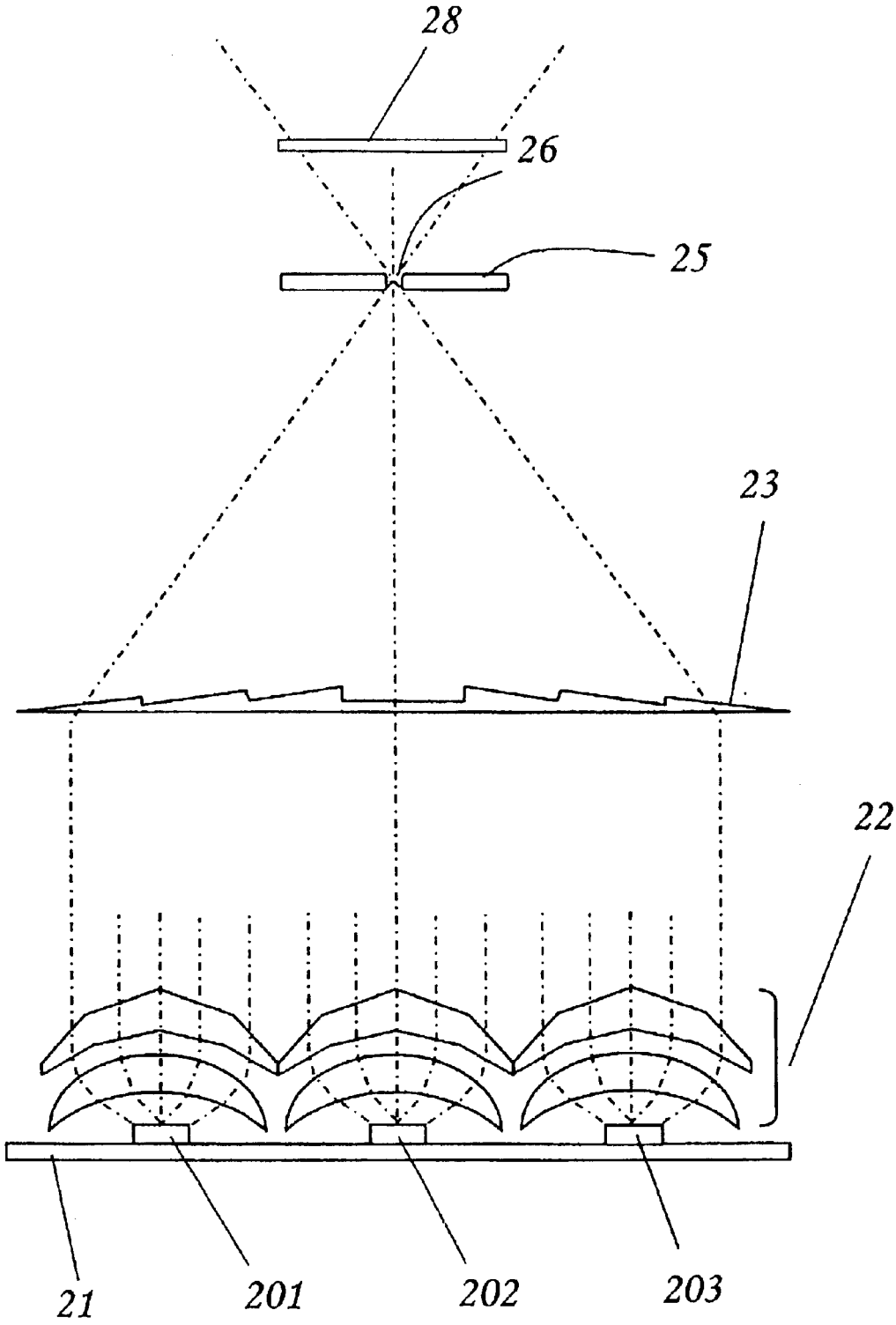
FIG. 6 shows a fifth embodiment of the invention where a focused light emitted from short wavelength LEDs through a pinhole is projected on a screen coated with phosphorescent material to produce white light.

FIG. 6 shows a fifth embodiment of the present invention. The light source system is similar to that shown in FIG. 5. In addition, a transparent plate 28 coated with phosphorescent material is placed in the path of the light beam radiated from the pin hole 26 in plate 25. The LEDs 201, 202, 203 mounted on the substrate 21 emit short wavelength light such as blue light, blue-purple light, purple light, ultra-violet light, etc. When such short wavelength light beams impinges on the transparent phosphorescent plate 28, the transmitted light becomes a white light.

Figure 7:
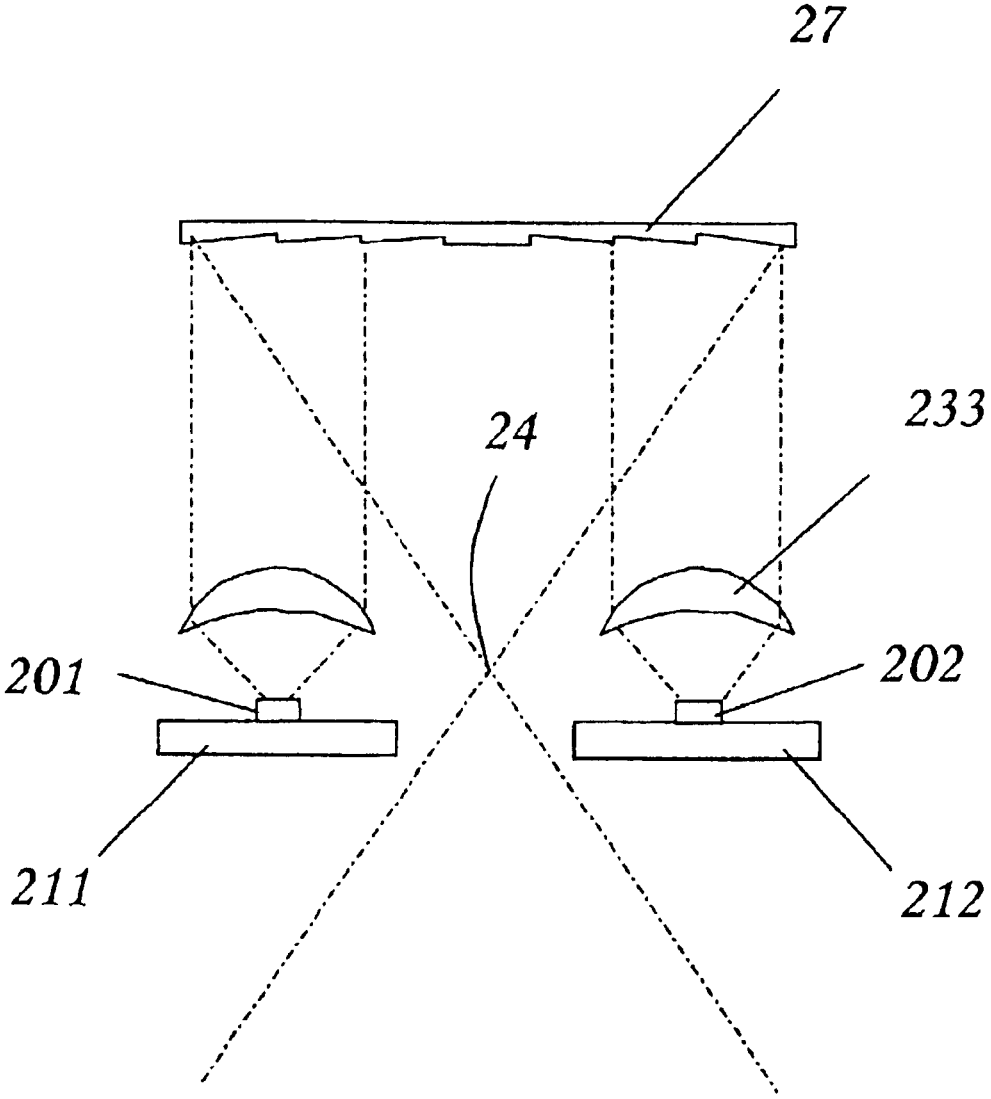
FIG. 7 shows a sixth embodiment of the invention where a focused light is reflected from a Fresnel lens with parallel light beam converted from the LEDs.

FIG. 7 shows a sixth embodiment of the present invention. The light source is based on reflected light. The lights emitted from the multiple LEDs 201 and 202, which are mounted on respective substrates 211 and 212, are converted into parallel light beams through first set of lenses 233 and projected on a second set of Fresnel lens 27, which reflects the parallel light beams. The reflected light beams is then focused at a point 24.

Figure 8:
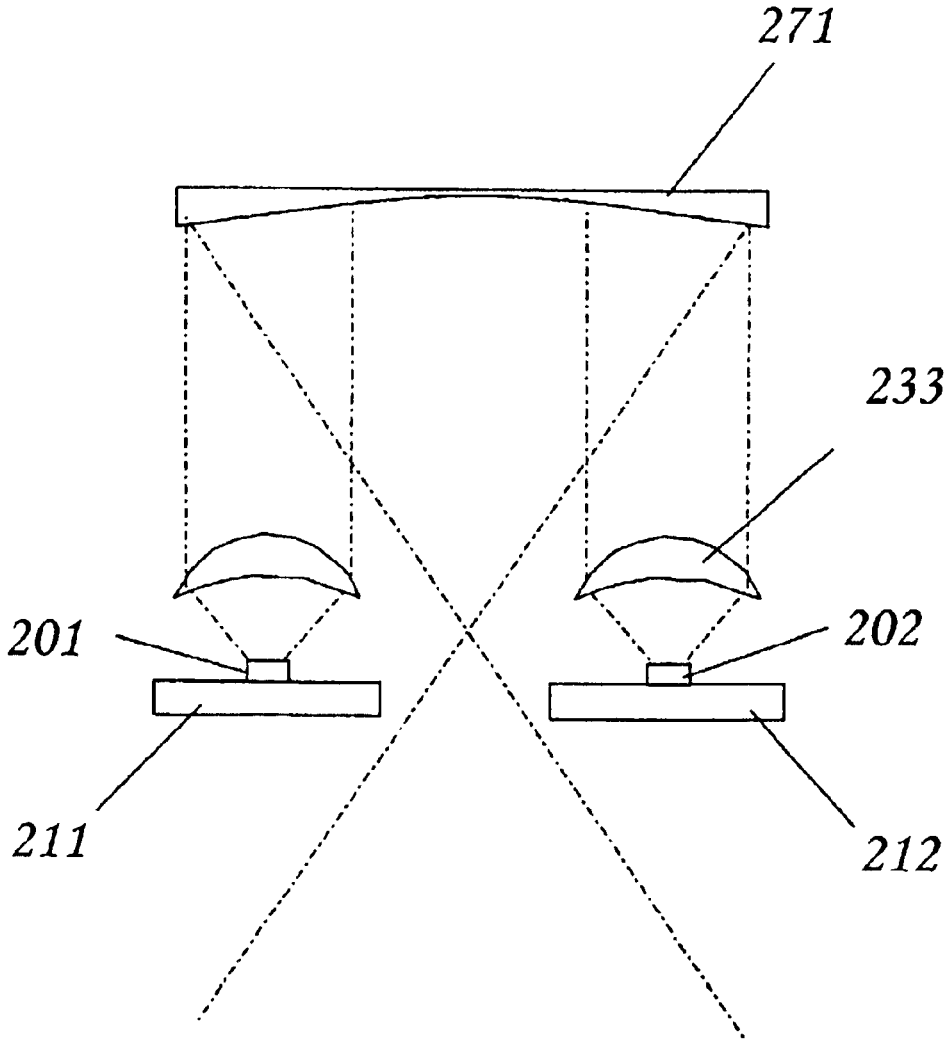
FIG. 8 shows a seventh embodiment of the invention where a focused light is reflected from a concave focusing lens.

FIG. 8 shows a seventh embodiment of the present invention The light source system is similar to that in FIG. 7, except that the second set of reflecting Fresnel lens 27 is replaced by a conventional concave lens 271. Other parts with same reference numerals corresponds to the same parts in FIG. 7

Figure 9:
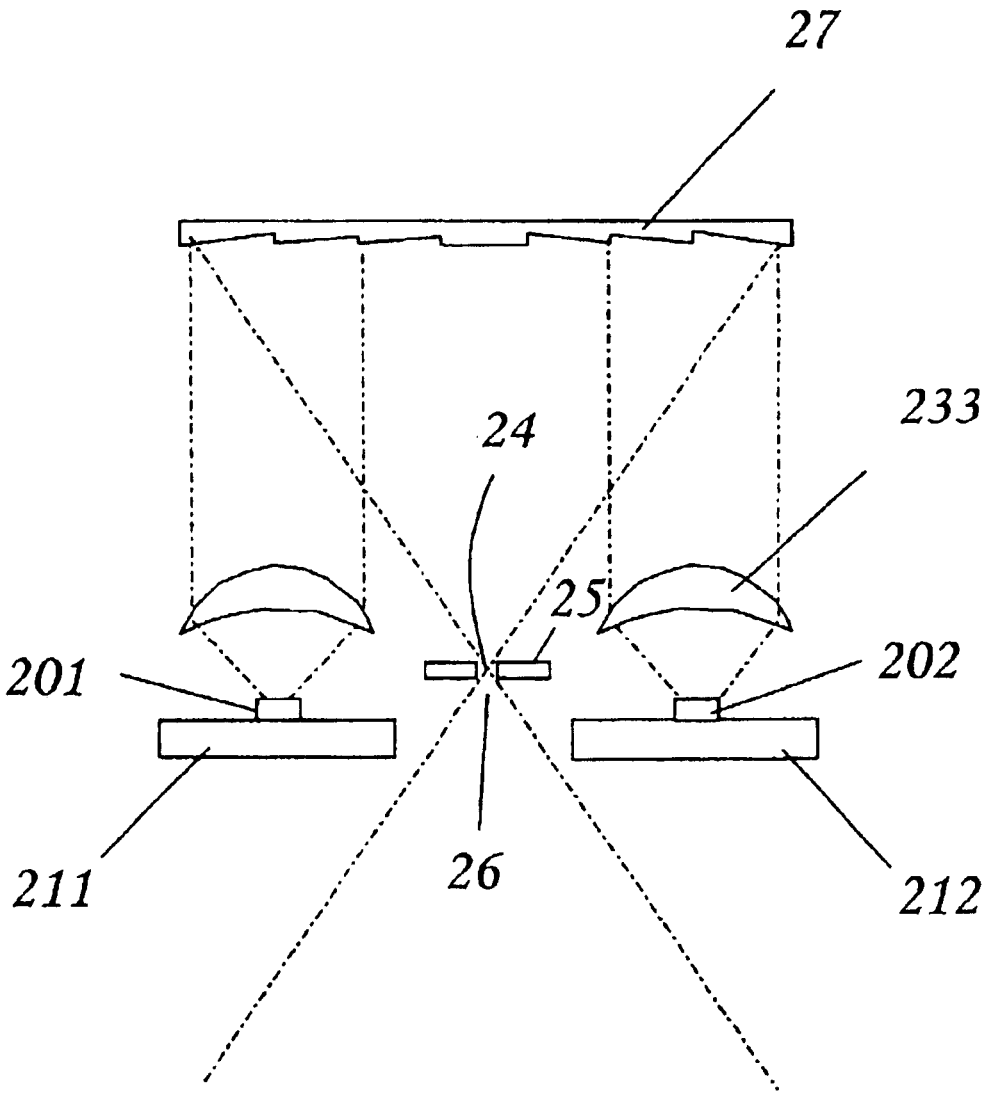
FIG. 9 shows an eighth embodiment of the invention where a focused beam reflected from a Fresnel lens is transmitted through a pinhole.

FIG. 9 shows an eighth embodiment of the present invention The light source system is similar to that in FIG. 7, except that the that the focused light transmit through a pinhole 26 of a plate 25 place at the focal point of the reflected light from the optical element 27. The pinhole sharpens the focused reflected light transmitted through the pinhole 26.

Figure 10:
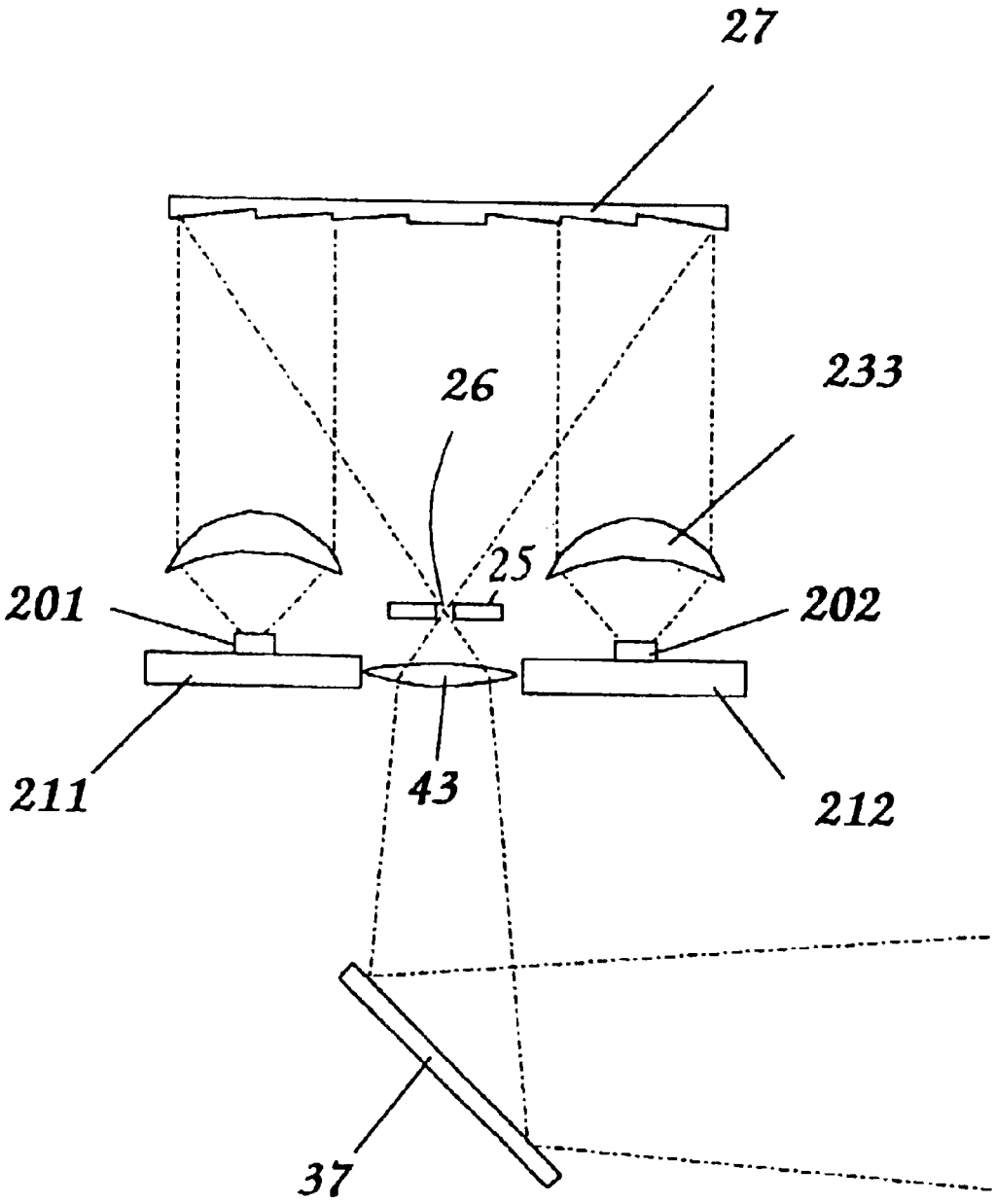
FIG. 10 shows a ninth embodiment of the invention where a focused beam is deflected by a mirror.

FIG. 10 shows a ninth embodiment of the present invention. The light source system is similar to that in FIG. 9 up to the pinhole 26. The light transmitted through the pinhole 26 is transmitted further through a magnifying lens 43 and deflected by a mirror 37. Thus, the direction of the light bean is deflected.

Figure 11:
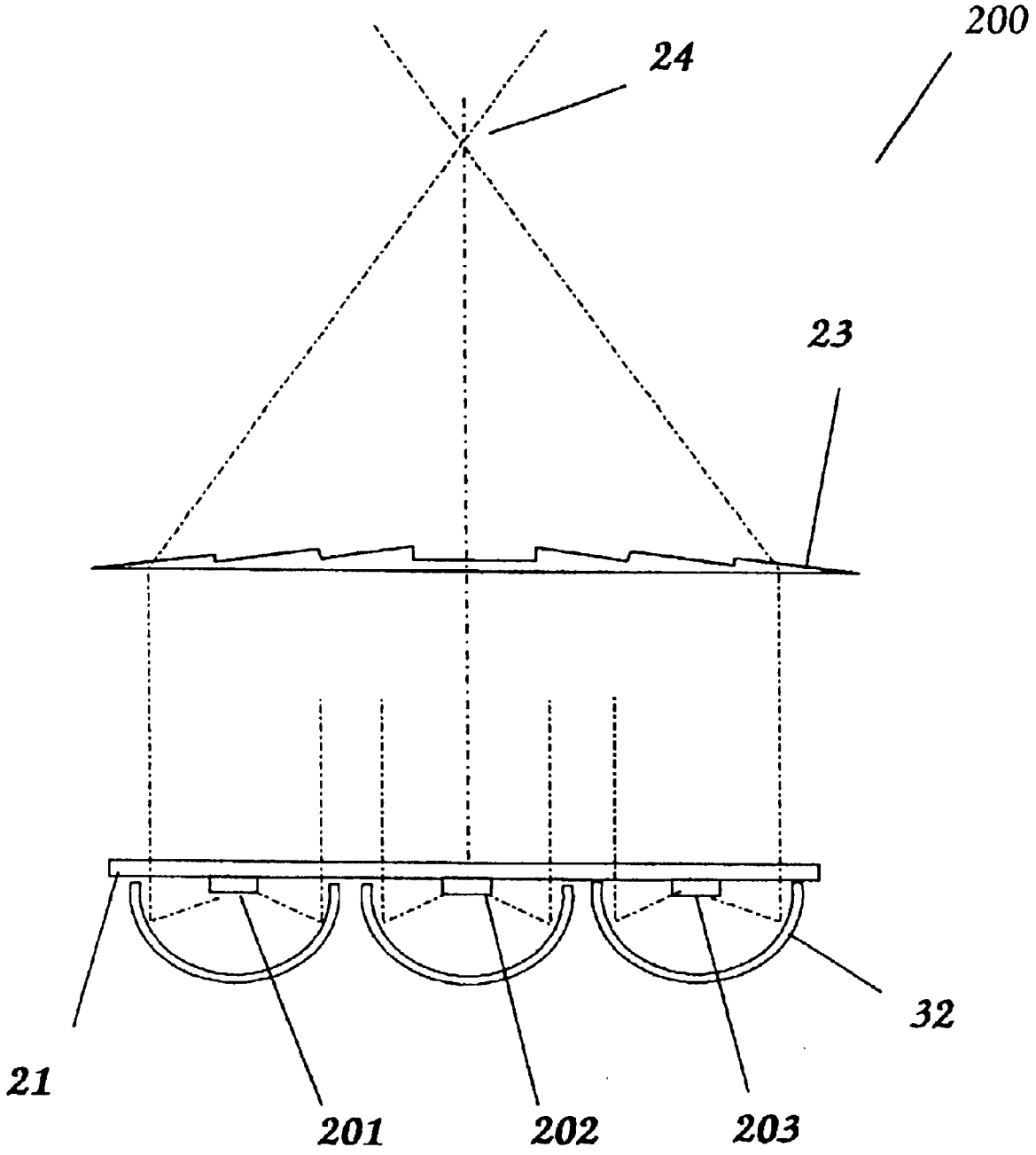
FIG. 11 shows a tenth embodiment of the invention where the parallel beam from the LEDs are reflected from reflecting cups underneath.

FIG. 11 shows a tenth embodiment of the present invention The LEDs 201, 202, 203 are mounted underneath the substrate 21. The LEDs are covered with a reflecting hemispheric cups 32 to reflect the light emitted from the LEDs into parallel light beams. The parallel light beams are then focused by a Fresnel lens 23 with focal point 24.

Figure 12:
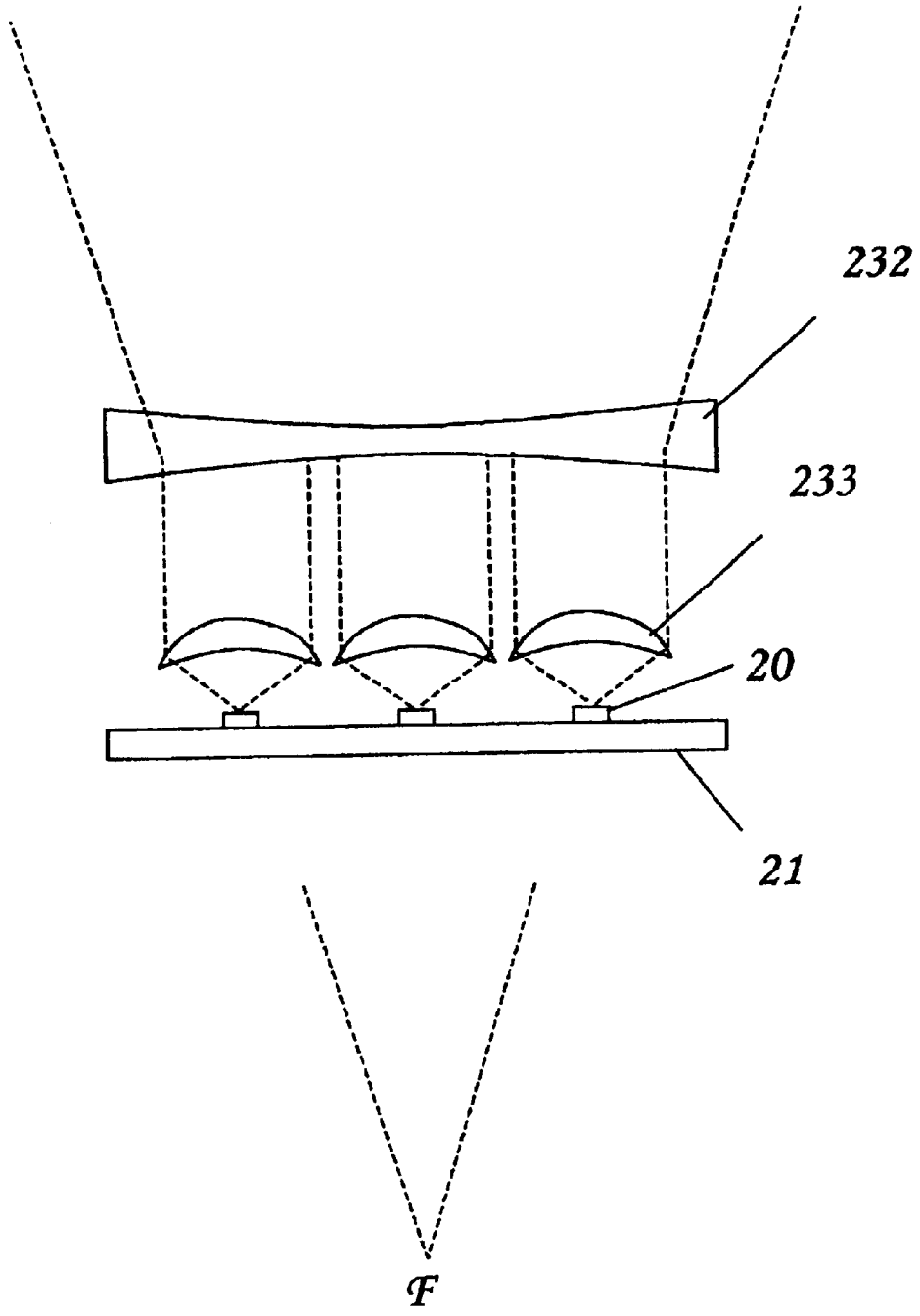
FIG. 12 shows an eleventh embodiment of the invention where the parallel light beam from the LEDs diverges with a concave lens.

FIG. 12 shows an eleventh embodiment of the present invention. The light source system is similar to that in FIG. 4, except that the second set of lens is a concave lens 232. The lights emitted from the LEDs 20 mounted on a substrate 21 are converted into parallel through a first set of lens 233. The parallel light beams are then transmitted through the concave lens 232 to become divergent. The divergent light has a virtual focal point F.

Figure 1:
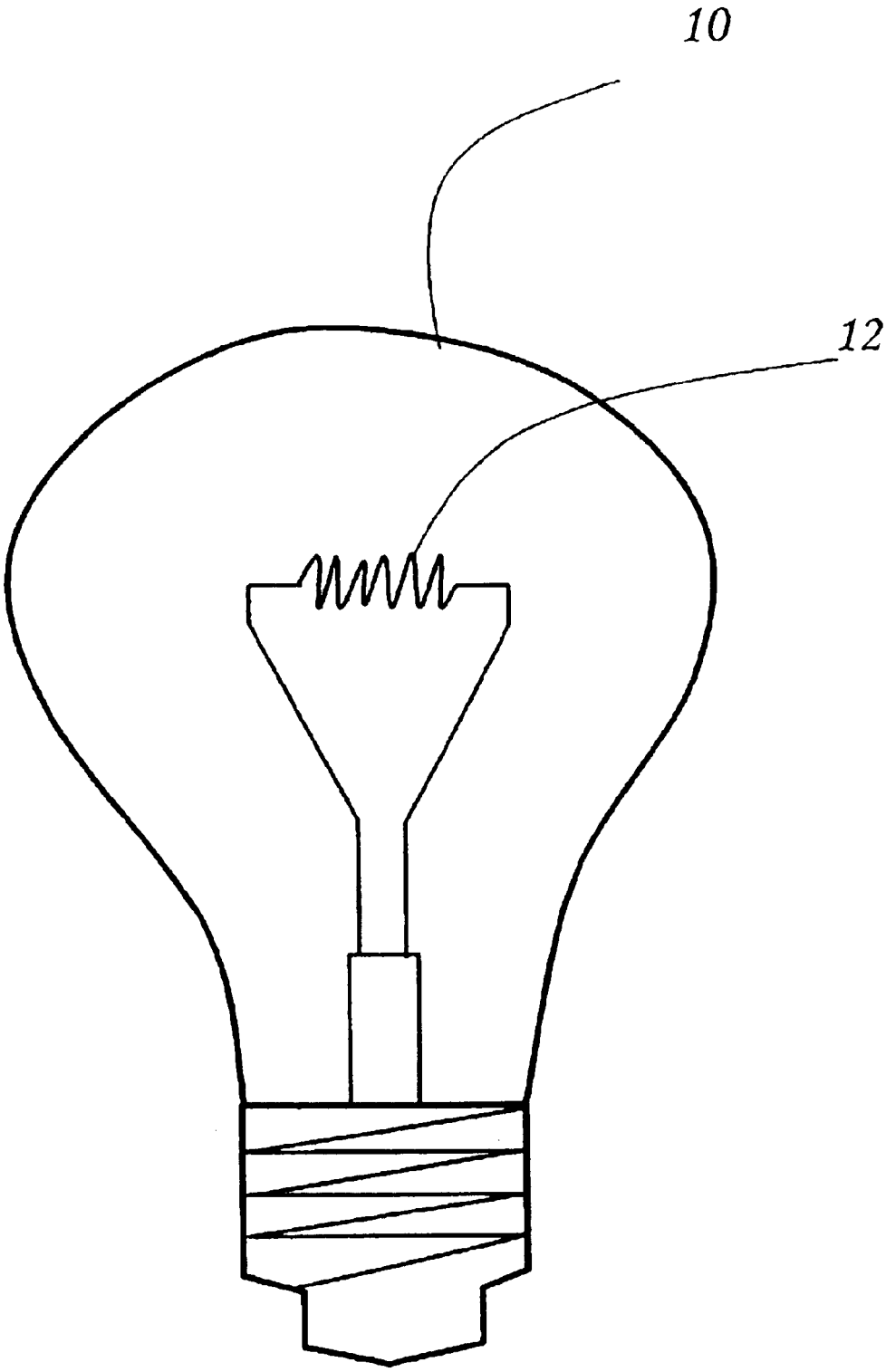
Fig. 1. Prior Art
FIG. 1 shows a traditional prior art light bulb
Figure 13:
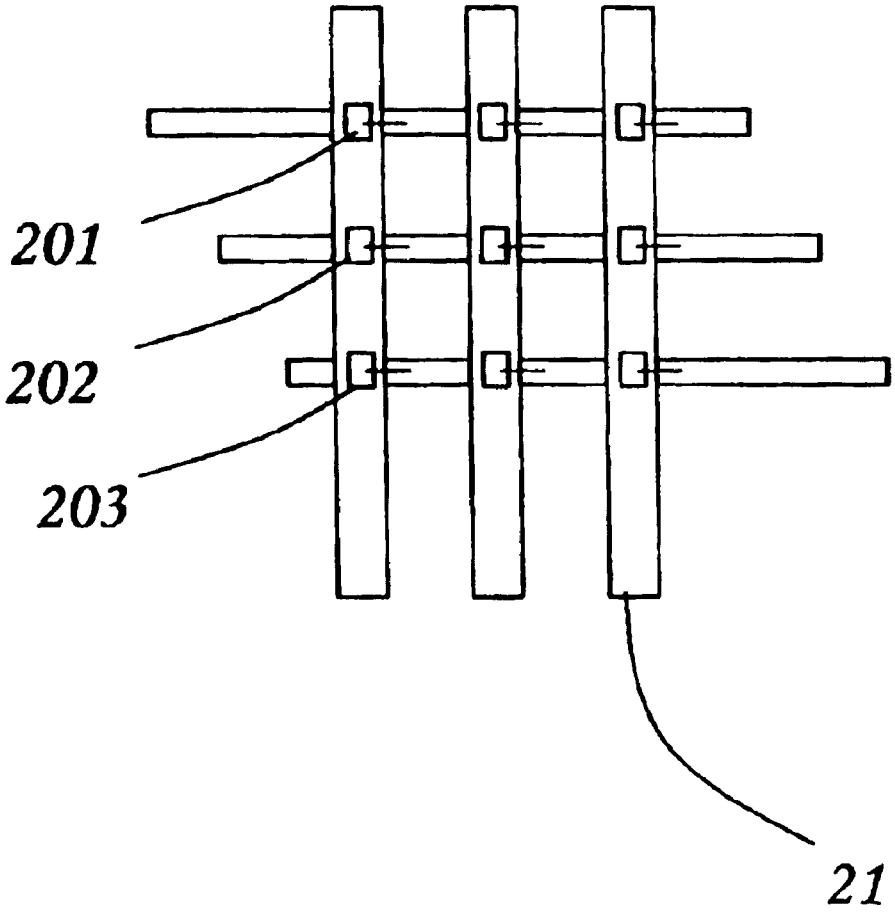
FIG. 13 shows a twelfth embodiment of the invention where the parallel beams from the LEDs are generated from a matrix of LEDs.

FIG. 13 shows a twelfth embodiment of the present invention. More than one substrate 21, each mounted with LEDs 201, 202, 203 similar to that shown in FIG. 1, are arranged as a matrix. Then, the light from the matrix projects as a wide angle light source.

While the preferred embodiments have been described, it will be apparent to those skilled in the art that various modifications may be made in the embodiment without departing from the spirit of the present invention. Such modifications are all within the scope of this invention.

What is claimed is:

1. A projection light source, comprising:

at least one light emitting diode (LED) mounted on a substrate;

a first set of optical element placed in front of said LED for converting emitted light from said LED into parallel light beam; and a second set of optical element for projecting said parallel light beam, wherein said first set of optical element is a set of lenses, and wherein said light source is enclosed in a light bulb.

2. A projection light source, comprising:

at least one light emitting diode (LED) mounted on a substrate;

a first set of optical element placed in front of said LED for converting emitted light from said LED into parallel light beam; and a second set of optical element for projecting said parallel light beam, wherein said second set of optical element is a Fresnel lens for focusing said parallel light beam as a focused light.

3. The projection light source as described in claim 2, wherein said light source is enclosed in a light bulb.

4. The projection light source as described in claim 2, further comprising a plate with a pinhole placed at a focal point of said focused light.

5. The projection light source as described in claim 4, wherein more than one said LED emit short wavelength light and further comprising a surface placed beyond the plate with a pinhole and coated with phosphorescent material to produce white light.

6. A projection light source, comprising:

at least one light emitting diode (LED) mounted on a substrate;

a first set of optical element placed in front of said LED for converting emitted light from said LED into parallel light beam; and a second set of optical element for projecting said parallel light beam, wherein said first set of optical element is a set of lenses, and wherein said second optical element is a concave lens for focusing said parallel light beam.

7. A projection light source, comprising:

at least one light emitting diode (LED) mounted on a substrate;

a first set of optical element placed in front of said LED for converting emitted light from said LED into parallel light beam; and a second set of optical element for projecting said parallel light beam, wherein said second optical element is a concave lens for reflecting said parallel light beam as the light source.

8. The projection light source as described in claim 7, further comprising a plate with a pin hole at a focal point of the light reflected from said Fresnel lens.

9. The projection light source as described in claim 8, further comprising a third lens and a mirror in the path of the light transmitted through said pinhole for deflecting the light transmitted through the pin hole.

* * * * *